US012377453B2

(12) United States Patent
Löffler et al.

(10) Patent No.: US 12,377,453 B2
(45) Date of Patent: Aug. 5, 2025

(54) DETERMINING A SENSITIVITY OF A TARGET VARIABLE OF A ROLLING MATERIAL FROM AN OPERATING VARIABLE OF A HOT ROLLING MILL

(71) Applicant: Primetals Technologies Germany GmbH, Erlangen (DE)

(72) Inventors: Hans-Ulrich Löffler, Erlangen (DE); Klaus Weinzierl, Nuremberg (DE)

(73) Assignee: Primetals Technologies Germany GmbH, Erlangen (DE)

( * ) Notice: Subject to any disclaimer, the term of this patent is extended or adjusted under 35 U.S.C. 154(b) by 346 days.

(21) Appl. No.: 17/798,595

(22) PCT Filed: Jan. 21, 2021

(86) PCT No.: PCT/EP2021/051350
§ 371 (c)(1),
(2) Date: Aug. 10, 2022

(87) PCT Pub. No.: WO2021/160404
PCT Pub. Date: Aug. 19, 2021

(65) Prior Publication Data

US 2023/0089119 A1 Mar. 23, 2023

(30) Foreign Application Priority Data

Feb. 11, 2020 (EP) ..... 20156622

(51) Int. Cl.
*B21B 37/76* (2006.01)
*B21B 37/16* (2006.01)
*B21B 37/58* (2006.01)

(52) U.S. Cl.
CPC ..... *B21B 37/76* (2013.01); *B21B 37/16* (2013.01); *B21B 37/58* (2013.01)

(58) Field of Classification Search
CPC ..... B21B 37/16; B21B 37/58; B21B 37/74; B21B 37/76; B21B 37/00
See application file for complete search history.

(56) References Cited

U.S. PATENT DOCUMENTS 4,274,273 A * 6/1981 Fapiano ..... C21D 8/0226 72/8.5
6,185,970 B1 * 2/2001 Latzel ..... C21D 11/005 72/200

(Continued)

FOREIGN PATENT DOCUMENTS

CN 1753734 A1 3/2006
CN 101767726 A 7/2010

(Continued)

OTHER PUBLICATIONS

International Search Report and Written Opinion received in International Application No. PCT/EP2021/051350 dated Mar. 31, 2021, 18 pages.

(Continued)

*Primary Examiner* — Edward T Tolan
(74) *Attorney, Agent, or Firm* — Liang & Hennessey LLP; Brian Hennessey

(57) ABSTRACT

A control device for a section of a hot rolling mill is supplied with respective primary data for a plurality of rolling materials and respective preliminary target values for the target variables of the respective rolling material. The respective primary data describes the respective rolling material before being supplied to the section of the hot rolling mill. The respective preliminary target values of the target variables describe a desired target state of the respective rolling material after passing through the section of the hot rolling mill. At least one of the target variables is a particular target variable, whereby the control device determines a respective final target value in such a way that it changes the respective (Continued)

preliminary target value by a respective offset. The respective offset is determined independently of the primary data and the other particular target variables and the normal target variables for the respective rolling material.

9 Claims, 6 Drawing Sheets

(56) References Cited

U.S. PATENT DOCUMENTS

| | | | | |
|---|---|---|---|---|
| 6,546,310 | B1 * | 4/2003 | Doll | G05B 13/0265 700/40 |
| 8,634,953 | B2 * | 1/2014 | Soderlund | B21B 37/44 72/8.2 |
| 9,751,165 | B2 * | 9/2017 | Dagner | B23P 17/00 |
| 11,319,611 | B2 * | 5/2022 | Biglari | G01N 23/2055 |
| 2016/0288181 | A1 | 10/2016 | Weinzierl | |

FOREIGN PATENT DOCUMENTS

| | | | |
|---|---|---|---|
| DE | 102016207692 | A1 | 11/2016 |
| DE | 102016114404 | A1 | 3/2017 |
| EP | 2873469 | A1 | 5/2015 |
| JP | 2016215237 | A | 12/2016 |
| JP | 2017051969 | A | 3/2017 |

OTHER PUBLICATIONS

European Search Report received in European Application No. 20156622.1 dated Aug. 20, 2020, 7 pages.

Office Action in Chinese Application No. 202180013992.X, mailed Jan. 4, 2025, the English translation is a machine translation of the German translation of the Chinese Office Action, 15 pages.

* cited by examiner

DETERMINING A SENSITIVITY OF A TARGET VARIABLE OF A ROLLING MATERIAL FROM AN OPERATING VARIABLE OF A HOT ROLLING MILL

CROSS-REFERENCE TO RELATED APPLICATIONS

The present application is a national phase application of PCT Application No. PCT/EP2021/051350, filed Jan. 21, 2021, entitled "DETERMINING A SENSITIVITY OF A TARGET VARIABLE OF A ROLLING MATERIAL FROM AN OPERATING VARIABLE OF A HOT ROLLING MILL", which claims the benefit of European Patent Application No. 20156622.1, filed Feb. 11, 2020, each of which is incorporated by reference in its entirety.

BACKGROUND OF THE INVENTION

1. Field of the Invention

The present invention is based on an operating method for a portion of a hot rolling mill.

2. Description of the Related Art

An operating method is disclosed for example in EP 2 873 469 A1. In this operating method, the portion is a cooling line or comprises a cooling line. In the context of this operating method, for a respective portion of a metal strip, using a total cooling function, a total coolant quantity is determined by means of which the respective portion of the metal strip is cooled in the cooling line. On the basis of models, an actual value of the portion of the metal strip expected on the basis of this cooling is determined and compared with a target variable. The total cooling function is updated on the basis of the difference. The total coolant quantity for the next portion of the metal strip is then determined from the regulated total cooling function. The adjustment of the total cooling function in principle corresponds to an adaptation of a sensitivity.

Also, DE 10 2016 207 692 A1 describes an operating method of the type cited initially. In this operating method, the portion of the hot rolling mill is a production line. Setpoints for the operation of the production line are determined. One of the setpoints is the final rolling temperature with which the rolling material should emerge from the production line. In the case of a change in rolling speed, a correction value for the final rolling temperature is determined. Coolant water quantities used to cool the rolling material inside the rolling mill are regulated on the basis of the modified final rolling temperature or the correction value.

A similar operating method is described in DE 10 2016 114 404 A1. Here, the portion of the hot rolling mill is however a cooling line downstream of a production line.

Firstly, the problem forming the basis for the present invention will be explained below.

A plurality of flat rolling materials is processed successively in the portion of the hot rolling mill. The primary data and the setpoints for the target variables of the respective rolling material are supplied to a model of the portion of the hot rolling mill. By means of the model, operating values for the portion of the hot rolling mill are determined such that, after passing through the portion of the hot rolling mill, the respective rolling material reaches the setpoints of the target variables as well as possible.

For example, a rolling mill may comprise a production line which is followed by a cooling line. If the cooling line is viewed as a portion of the hot rolling mill, for example one of the target variables may be the reeling temperature which the flat rolling material should reach after passing through the cooling line. The associated setpoint may for example be 600° C. The associated operating value may be the number of valves which must be actuated in order to achieve the necessary cooling of the flat rolling material. The number of switched valves in this case constitutes the control element. The corresponding operating value may for example be 10 valves.

Also, another target variable may be predefined, for example a specific material property of the flat rolling material. Examples of such material properties are the proof stress, the yield strength, the breaking strength and others. In this case, completely similar procedures are possible, wherein however also in this case the reeling temperature may be regarded as an operating value of the portion of the hot rolling mill.

During passage of the respective flat rolling material through the portion of the hot rolling mill, measurements are taken. From these measurements, correcting variables for the portion of the hot rolling mill are updated. If for example a reeling temperature of 600° C. is prescribed as a target variable, and the correcting variable is the number of switched valves, the reeling temperature may be detected from the time at which the start of the respective flat rolling material reaches a temperature measurement point downstream of the cooling line. If in this case a deviation is found, the actuation of the valves of the cooling line is updated. If the corresponding point of the flat rolling material does not for example show 600° C. but 610° C., a further valve is switched on so that the flat rolling material is cooled via 11 valves. If, conversely, the corresponding point of the flat rolling material does not show 600° C. but 590° C., a valve is switched off so that the flat rolling material is cooled only via 9 valves.

After passing through the portion of the hot rolling mill, a test can be carried out on the now treated flat rolling material. For example, a material specimen may be taken and inspected for microscopic material properties, such as for example structure or grain size, and macroscopic material properties such as tensile strength, yield strength and ductile yield.

The aim now is to determine correction values for primary data and correction values for operating values from the detected actual reeling temperature or from the material properties in conjunction with the actual operating values. Primary data are corrected if it must be assumed that the actually desired material, as defined by the setpoints of the target variables, cannot be produced even with adaptation of the operating values. Correction values for operating values are determined if it can be assumed that the actually desired material, as defined by the setpoints of the target variables, can indeed be produced but for this an adaptation of the operating values is required. An adaptation of operating values may be necessary for example if the primary data have changed but the setpoints of the target variables should nonetheless still be reached.

In order to be able to suitably determine the necessary adaptations to the operating values, it is necessary to know the sensitivities with which specific operating variables influence specific target variables. It must therefore be known to what extent a value of a specific target variable changes if an operating value of a specific operating variable is changed by a specific value.

Attempts have been made to determine such relationships in the prior art. For example, attempts were made to create a model of the cooling line of a hot rolling mill, by means of which, for given primary data and given operating values, the resulting target variables can be determined. The target variables were for example macroscopic material properties, such as tensile strength, yield strength and ductile yield. By correspondingly varying the operating values, "correct" operating values could then be determined in order to reach the desired target variables. The model of the cooling line was in some cases an analytical model which was based on mathematical-physical equations. In other cases, such an analytical model was corrected, supplemented or replaced by a neuronal network. The neuronal network naturally had to be trained accordingly.

The model was used for example to calculate, before passage of the respective flat rolling material through the cooling line, a reeling temperature which the respective flat rolling material should present in order to have the desired macroscopic material properties. The respective flat rolling material was then cooled in the cooling line such that it presented the determined reeling temperature.

The procedure of the prior art has substantial systematic defects. In particular, even during passage of the respective flat rolling material through the portion of the hot rolling mill, correcting variables are updated constantly via regulation circuits. For example, in the case of a cooling line, the reeling temperature is detected and the quantity of cooling water which is to be applied to the respective flat rolling material is adjusted. In this way, the determined setpoint of the reeling temperature is maintained as well as possible. As a result, in the prior art, only very few data sets occur in which (for example) the reeling temperature deviates from its setpoint. In this way, the setpoints for the target variables for the one given target point may indeed be determined quite precisely. The model however very quickly becomes imprecise and defective if other setpoints for the target variables are predefined and/or other primary data are present. It may even occur that corrections are made in the wrong direction, wherein for example on an increase in the desired tensile strength, the model determines a reduction in reeling temperature although the reeling temperature should have been increased. Calculation of the correction is therefore very difficult. A reduction in any spread cannot be achieved, or only with great difficulty.

The problem is clarified below with reference to an example.

In the case of a cooling line, it is assumed that all flat rolling materials consist of steel, have the same primary data (e.g. same chemical composition, final rolling thickness 3 mm, final rolling temperature 900° C., final rolling speed 10 m/s etc.), and should be cooled to the same reeling temperature of 600° C. The cooling is then set to give this 600° C. Purely as an example, it is assumed below that, for this, the first 10 valves of the cooling line must be switched on. The actual reeling temperature is measured at the outlet from the cooling line.

If now—for any reason—in a portion of the flat rolling material, there is an unexpected deviation of the detected reeling temperature from the desired reeling temperature, corrective intervention is made on the cooling so that, for the following portions of the flat rolling material, the detected reeling temperature is regulated to the desired reeling temperature. If the detected reeling temperature is too high, thus (at least) one valve is switched on or actuated to a greater extent. If however the reeling temperature is too low, (at least) one valve is switched off or actuated to a lesser extent.

As part of a downstream statistical analysis, the extent of cooling (e.g. the number of valves switched on) and the respective measured reeling temperature are entered in a diagram. The diagram shows for example the extent of cooling along the X axis and the reeling temperature along the Y axis. In this way a regression gradient is determined.

If for example only data points with 9, 10 and 11 switched valves occur, it cannot easily be determined what the cooling effect will be if for example firstly 8 or fewer valves are switched on, or secondly 12 or more valves. Also, the statistical analysis for 9, 10 and 11 switched valves leads to a false and erroneous result. Because of the regulation of the cooling in the cooling line, the data points substantially all have a reeling temperature of 600° C. It cannot therefore be concluded from the diagram that switching valves on or off has any influence at all on the cooling effect. On the contrary, the diagram gives the impression that switching valves on or off has no influence on the cooling effect. This is clearly false. There is evidently an influence. But this cannot be determined from the diagram.

SUMMARY OF THE INVENTION

Before the present invention, it was found that the problem of the prior art is that switching valves on and off is not statistically independent of the actual state of the respective flat rolling material before passing through the cooling line. This will be explained in more detail below.

If the primary data are completely correct and the model is completely correct, the model calculation and the activation of the valves of the cooling line based thereon will also be correct. Since however corrections occur, an error must have occurred at some point. The error as such need not be known. It is however present. This error is regulated out by the updating of the cooling in the cooling line. However, the updating of the cooling is stochastically dependent on the error. The correlation evident from the diagram therefore shows the correlation between the reeling temperature on one side and the extent of cooling, inclusive of the error occurring, on the other. In order to determine the sensitivity of the reeling temperature to the extent of cooling, the error must however be eliminated. Therefore the correlation between the reeling temperature on one side, and the extent of cooling without the occurring error on the other, must be determined.

In order to eliminate the error, it is theoretically conceivable to disable the regulation, i.e. to take the actual reeling temperature as it is. This is not however easily possible in practice, since disabling such regulation may lead to considerable deviations from the desired target variables—directly, the reeling temperature and, consequently, the material properties. Lower quality material, which may not even be saleable, is produced. In practice therefore, other ways must be found to determine the sensitivity.

The object of the present invention is to create possibilities by means of which the sensitivity of a particular target variable of flat rolling materials to operating values of a portion of a hot rolling mill can be determined.

The object is achieved by an operating method for a portion of a hot rolling mill with the features of the claims. The present invention is based on an operating method for a portion of a hot rolling mill, wherein a control device for the portion of the hot rolling mill is supplied with respective primary data for a plurality of rolling materials and respective provisional setpoints for target variables of the respective rolling material, wherein the respective primary data describe the respective rolling material before being supplied to the portion of the hot rolling mill, and the respective provisional setpoints of the target variables describe a desired nominal state of the respective rolling material after passing through the portion of the hot rolling mill, wherein the control device determines operating values for the portion of the hot rolling mill such that the respective rolling material, after passing through the portion of the hot rolling mill, reaches definitive setpoints of the target variables as well as possible, wherein during processing of the respective rolling material, the control device operates the portion of the hot rolling mill according to the determined operating values.

The present invention is furthermore based on a computer program for a control device for a portion of a hot rolling mill for processing a plurality of rolling materials, wherein the computer program comprises machine code which can be processed by the control device, wherein the processing of the machine code by the control device causes the control device to execute such an operating method.

The present invention is furthermore based on a control device for a portion of a hot rolling mill for processing a plurality of rolling materials, wherein the control device is programmed with such a computer program so that during operation, the control device executes such an operating method.

The present invention is furthermore based on a portion of a hot rolling mill for processing a plurality of rolling materials, wherein the portion of the hot rolling mill is controlled by such a control device.

Advantageous embodiments of the operating method are the subject of the dependent claims.

According to the invention, an operating method of the type cited initially is configured such that:

at least one of the target variables is a particular target variable, and the remaining target variables are normal target variables, the control device determines the respective definitive setpoint for the particular target variable in that it changes the respective provisional setpoint by a respective offset which is determined independently of the primary data, the other particular target variables and the normal target variables for the respective rolling material, and also independently of the operating values of the hot rolling mill determined for processing the respective rolling material, the offsets, with respect to the respective particular target variable, have multiple different values when all the rolling materials are viewed as a whole, and the control device, for the normal target variables, uses the respective provisional setpoint unchanged as the respective definitive setpoint.

In contrast to the prior art, in which the control device takes the provisional setpoints of all target variables 1:1 as definitive setpoints, in the context of the present invention, this procedure is used only for the normal target variables. For the particular target variables, however, the provisional setpoints are changed by offsets. As a result, viewed over several identical rolling materials, there are multiple setpoints for the respective target variable which are stochastically independent both of the setpoints of the other target variables and also of the other primary data. Even with the same provisional setpoint of a specific particular target variable, multiple definitive setpoints are thus created.

Because the definitive setpoints of the respective particular target variable are stochastically independent of the primary data and the other target variables, then necessarily also the variation in the associated operating values is stochastically dependent only on the respective definitive setpoint of the particular target variable.

As a result, for the respective mean value of the associated operating values, there is a functional dependence only on the respective definitive setpoint of the respective particular target variable. Only by this procedure is it possible, using the mean values of the operating values and the respective associated definitive setpoints of the respective particular target variable, to determine a suitable value for the sensitivity of the respective particular target variable to the respective operating variable.

During passage of the respective rolling material through the portion of the hot rolling mill, an actual value of a state variable of the rolling material, for example the respective reeling temperature, is supplied to the control device. It is possible that the state variable is one of the particular target variables, so that a setpoint of the state variable corresponds to the definitive setpoint of this particular target variable. This is the case for example if a setpoint for the reeling temperature is directly predefined. Alternatively, it is possible that the state variable correlates with the at least one particular target variable, so that a setpoint of the state variable is determined by the definitive setpoint of the at least one particular target variable. This is the case for example if the setpoint for the reeling temperature is determined such that the flat rolling material has a certain material property (=particular target variable). In some cases, on a deviation of the actual value of the state variable from the setpoint of the state variable, the control device may update at least one operating value which influences the state variable, in order to compensate for the deviation of the actual value of the state variable from the setpoint of the state variable. For example, the number of switched valves of a cooling line may be changed in order to set a certain reeling temperature.

In particular in the case that the particular target variable is a material property of the respective flat rolling material, the state variable correlating with the particular target variable may be the reeling temperature at the outlet from the cooling line, and an operating value may still be the number of actuated valves of the cooling line and/or the extent of actuation of the valves of the cooling line. This is however not absolutely necessary.

The offsets may be determined as required. In particular, they may be freely selectable completely or within a predefined value range. If the offsets are completely freely selectable, an operator predefining the offset must select this suitably. If the offsets are freely selectable within a predefined value range, the value range must be predefined suitably.

For example, it is possible to determine the respective setpoint of the respective particular target variable in that the respective provisional setpoint is increased by a predefined value for some of the flat rolling materials and reduced by the same value for others of the flat rolling materials. In some cases, a division into three may take place, i.e. in addition, for some of the flat rolling materials, the respective provisional setpoint of the respective particular target variable is used unchanged as the respective definitive setpoint. Here, two concrete examples are given in which the respective provisional setpoint is uniform and the particular target variable is the reeling temperature.

In the context of both examples, it is assumed that to produce an actually desired material, a model calculation gives a reeling temperature of 600° C. Said 600° C. in this case corresponds to the provisional setpoint. Now, for example, a part of the flat rolling materials is produced such that the reeling temperature is 610° C. A further part of the flat rolling materials is produced such that the reeling temperature is 590° C. This procedure corresponds to offsets of +10K and −10K which are additively linked to the provisional setpoint. An alternative procedure would be to produce parts of the flat rolling materials with respective reeling temperatures of 590° C., 600° C. and 610° C. This procedure would correspond to offsets of +10K, 0K and −10K which are additively linked to the provisional setpoint.

As already stated, the operating values may sometimes be updated during passage of the respective rolling material through the portion of the hot rolling mill. Thus the actual value of the state variable corresponds precisely, or with only a very low spread, to the setpoint of the state variable. In this case however, with respect to a specific definitive setpoint of a particular target variable, the operating values vary with a respective statistical spread. Preferably, in this case, with respect to the respective particular target variable, the offsets are selected such that the mean values of the at least one operating value for the respective definitive setpoint of this target variable deviate by less than the spread, in particular by less than half the spread, from the mean value of the at least one operating value which results on use of the respective provisional setpoint as the definitive setpoint of this particular target variable.

If the operating values for the respective rolling material are not updated on passage through the portion of the hot rolling mill, conversely, with respect to the respective particular target variable, the actual value, which would result on use of the definitive provisional setpoint as the respective definitive setpoint, varies with a statistical spread. It is therefore alternatively also possible that the respective offset for this particular target variable is smaller than the spread, in particular smaller than half this spread.

In a common application, the portion of the hot rolling mill comprises a cooling line, and one of the particular target variables is the reeling temperature of the rolling material at the outlet from the cooling line, or correlates with the reeling temperature of the rolling material at the outlet from the cooling line. In this case, in particular the number of actuated valves of the cooling line and/or the extent of actuation of the valves of the cooling line may be influenced by at least one of the operating values.

The particular target variable itself may, as already stated, be the reeling temperature at the outlet from the cooling line. Also however, it is possible that at least one of the particular target variables is a microscopic or macroscopic material property of the respective rolling material. In this case, the operating values may for example directly influence the reeling temperature or the number of actuated valves of the cooling line and/or the extent of actuation of the valves of the cooling line. A microscopic material property may for example be the grain structure or the grain size. A macroscopic material property may for example be the tensile strength, the yield strength or the ductile yield.

The object is furthermore achieved by a computer program with the features of claim 8. According to the invention, the processing of the computer program by the control device causes the control device to execute an operating method according to the invention.

The object is furthermore achieved by a control device for a portion of a hot rolling mill for processing a plurality of rolling materials with the features of claim 9. According to the invention, the control device is programmed with a computer program according to the invention so that during operation, the control device executes an operating method according to the invention.

The object is furthermore achieved by a portion of a hot rolling mill for processing a plurality of rolling materials. According to the invention, the portion of the hot rolling mill is controlled by a control device according to the invention.

BRIEF DESCRIPTION OF THE DRAWINGS

The above-described properties, features and advantages of this invention, and the manner and fashion in which these are achieved, will become evident and more clearly comprehensible in connection with the following description of exemplary embodiments, which are explained in more detail in conjunction with the drawings. For this, in schematic illustrations.

DETAILED DESCRIPTION

Figure 1:
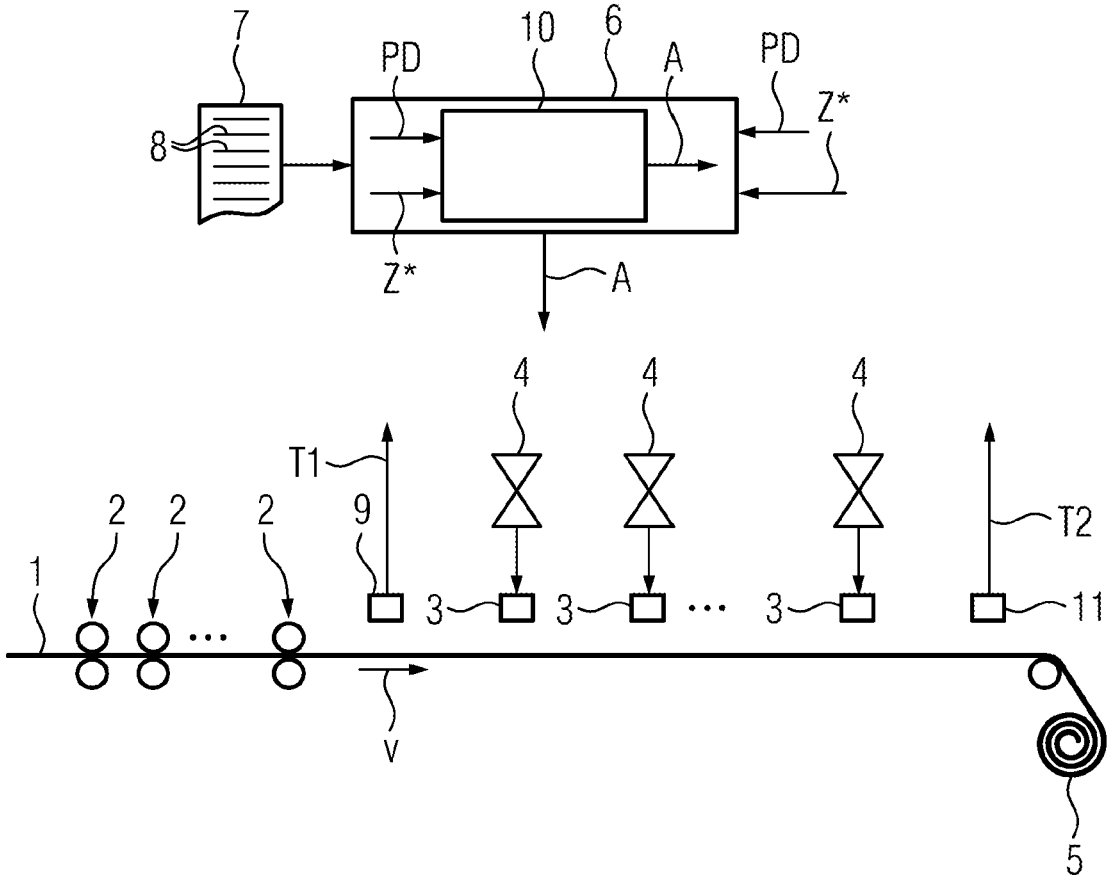
FIG. 1 shows a possible embodiment of a hot rolling mill from the side.
Figure 2:
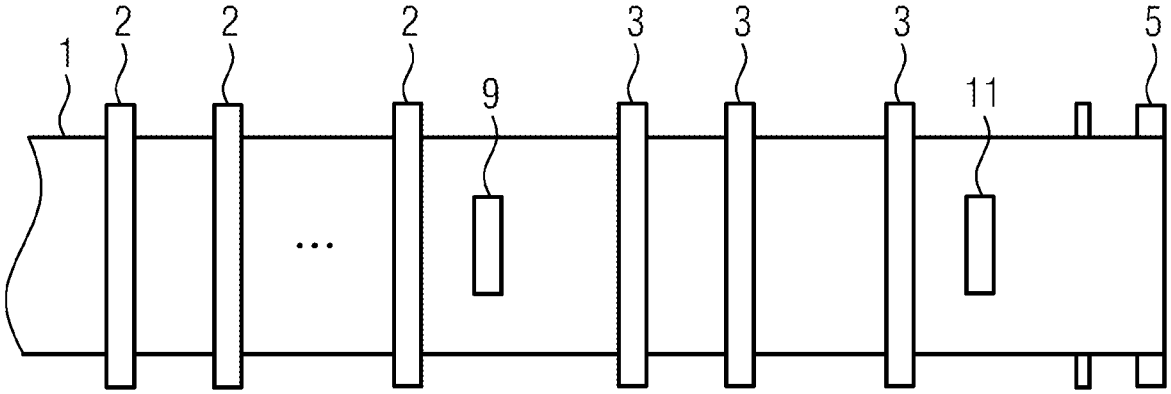
FIG. 2 shows the hot rolling mill from FIG. 1 from above.

According to FIGS. 1 and 2, a hot rolling mill is configured for processing rolling materials 1 consisting of metal. Usually, the rolling materials 1 consist of steel. In some cases however, they may also consist of aluminum or another metal. The rolling materials 1 are flat rolling materials, as evident from the illustrations in FIGS. 1 and 2. Usually, the rolling materials 1 are strips. Alternatively however, they may also be plates.

The hot rolling mill has at least one roll stand 2. Often, several roll stands 2 are arranged sequentially behind one another. The roll stands 2 may for example form a multistand production line. In many cases, furthermore a cooling line is arranged downstream of the roll stand 2 (or in the case of multiple roll stands 2, the last roll stand 2). FIGS. 1 and 2 show only the working rolls of the roll stands 2. Often, the roll stands 2 also comprise support rolls and in some cases further rolls. The cooling line usually comprises several cooling devices 3. A liquid coolant is supplied to the cooling devices 3 via valves 4. The coolant is usually water. In some cases, it is also water with certain additives. FIGS. 1 and 2 show only cooling devices 3 above the rolling material 1. Usually however, cooling devices 3 are arranged both above and below the rolling material 1. In the hot rolling mill, the rolling materials 1 may be rolled in the roll stands 2 and/or cooled by means of the cooling devices 3 of the cooling line. Both the rolling and the cooling correspond to a processing of the rolling materials 1.

In many cases, the hot rolling mill furthermore comprises a reeling device with at least one reel 5. The reeling device is in each case arranged downstream of the roll stands 2. If the cooling line is present, the reeling device is also arranged downstream of the cooling line. In this case, the cooling line is thus arranged between the roll stands 2 and the reeling device.

The hot rolling mill may furthermore also comprise units which are arranged upstream of the roll stands 2. One example of such a unit is a descaling device.

The hot rolling mill thus comprises at least one portion. It is possible that the roll stands 2, or the production line together with the cooling line and/or at least one upstream device, are regarded as the portion of the hot rolling mill. Alternatively, it is possible to regard only the roll stands 2 or the production line as the portion of the hot rolling mill. It is also possible to regard only the cooling line or only the upstream device as the portion of the hot rolling mill. In the description which follows, the cooling line is considered as the portion of the hot rolling mill. This is however not absolutely necessary.

The portion of the hot rolling mill is controlled by a control device 6. In the present case, the control device 6 in particular controls the valves 4 of the cooling devices 3. Alternatively or additionally, the control device 6 may also actuate at least one pump (not shown) by means of which the working pressure and/or the coolant flow may be set. In some cases, the control device 6 may also control further parts of the hot rolling mill, such as for example the roll stands 2 and the reel 5 or reels 5. The control device 6 is programmed with a computer program 7. The computer program 7 comprises machine code 8 which can be processed by the control device 6. The processing of the machine code 8 by the control device 6 causes the control device 6 to control the portion of the hot rolling mill according to an operating method which will be described in more detail below.

The flat rolling materials 1 are processed individually and successively in the portion of the hot rolling mill. Insofar as the portion of the hot rolling mill is controlled directly, this control is executed separately for each individual flat rolling material 1. This control is explained below in connection with FIG. 3 for an individual flat rolling material 1.

Figure 3:
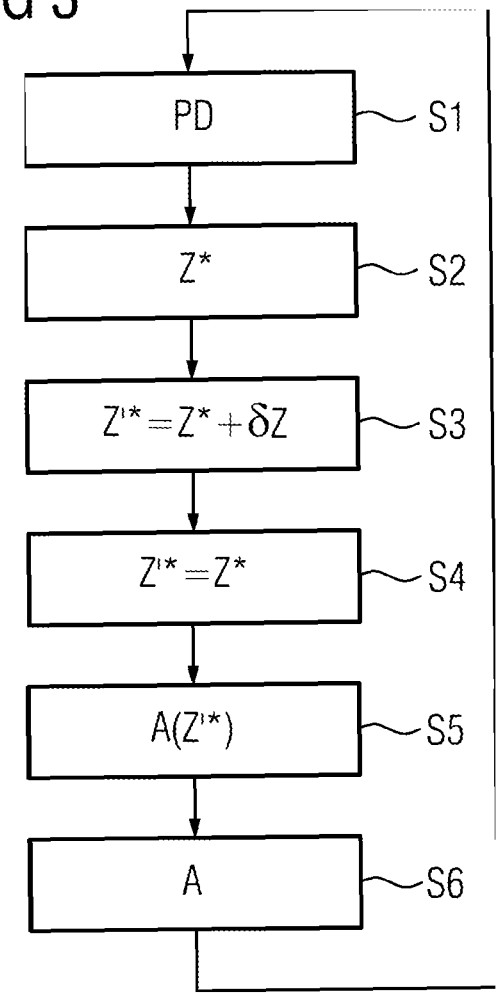
FIGS. 3 and 4 show flow diagrams.

According to FIG. 3, in a step S1, the control device 6 receives primary data PD for a respective flat rolling material 1. The primary data PD describe the respective rolling material 1 before it is supplied to the portion of the hot rolling mill. In the given example (portion of hot rolling mill=cooling line), the primary data PD may for example comprise the chemical composition of the flat rolling material 1, its final rolling temperature T1, its thickness, its width and the final rolling speed v. The primary data PD thus specify which material is to be processed in the portion of the hot rolling mill, and/or the state of the rolling material 1 on supply to the portion of the hot rolling mill. The final rolling temperature T1 may for example be detected instantaneously by means of a corresponding temperature measurement point 9 (see FIGS. 1 and 2).

In a step S2, the control device 6 receives provisional setpoints Z* for target variables for the rolling material 1. The provisional setpoints Z* of the target variables describe properties of the respective rolling material 1 which the latter should have after passing through the portion of the hot rolling mill. These properties are therefore target properties. The target variables or their provisional setpoints Z* thus indicate the desired properties of the rolling material 1 after passage through the portion of the hot rolling mill, and/or the desired state of the respective rolling material 1 at that time. The target variables may for example be macroscopic or microscopic material properties of the flat rolling material 1. A macroscopic material property may for example be the tensile strength, the yield strength or the ductile yield. A microscopic material property may for example be the grain structure or grain size. Also, a setpoint T2* may be predefined for the reeling temperature T2 which the flat rolling material 1 should have after the cooling line. In this case, the reeling temperature T2 is a target variable.

At least one of the target variables is a particular target variable. It is conceivable that the control device 6 itself determines which of the target variables are particular target variables. Usually however, it is prespecified for the control device 6 which of the target variables are particular target variables. This may be prespecified for example as part of the computer program 7 or by an operator (not shown).

For the particular target variables, in a step S3, the control device 6 changes the respective provisional setpoint Z* by an offset δZ, and thus determines a respective definitive setpoint Z'*. The definitive setpoint Z'* for the respective particular target variable is therefore $Z'^*=Z^*+\delta Z$.

It is possible that the control device 6 itself determines the respective offset δZ. In this case, usually the control device 6 is given a framework—for example as part of the computer program 7 or by an operator—within which the control device 6 itself determines the respective offset δZ. For example, the control device 6 may be given a maximum amount of the offset δZ, below which the control device 6 establishes a value at random. It is also possible that the control device 6 is given several concrete possible values for the offset δZ, and the control device 6 selects one of these values. In this case, the respective offset δZ may be freely selected by the control device 6 within a predefined value range. The value range is predefined either by the framework or by the smallest and largest possible offset δZ. It is also possible that the respective offset δZ of the control device 6 is predefined by the operator. In this case, the respective offset δZ may be freely selected by the operator. In some cases, it may be possible that a corresponding value range or several possible values are stored in the control device, and the operator each time selects a value from this value range or one of the possible values. Irrespective of the method of establishing the offset δZ, the offset δZ is however established independently of the primary data PD and also independently of the other target values. Also, the offsets are determined independently of operating values A of the hot rolling mill.

For the other target variables, i.e. the target variables which are not particular target variables, in a step S4, the control device 6 directly uses the respective provisional setpoint Z* as the respective definitive setpoint Z'*. For these target variables, referred to below as normal target variables, therefore Z'*=Z*.

Then, in a step S5, the control device 6 determines the operating values A of the portion of the hot rolling mill. These are determined such that, after passing through the portion of the hot rolling mill, the respective rolling material 1 has reached the definitive setpoints Z'* of the target variables as well as possible. The operating values A thus indicate how the portion of the hot rolling mill must be actuated in order for the rolling material 1, for given primary data PD, to reach the definitive setpoints Z'* of the target variables. At least this is expected. For example, the control device 6 may supply the primary data PD and the definitive setpoints Z* of the target variables to a model 10 of the portion of the hot rolling mill, as shown in the illustration in FIG. 1. In this case, the operating values A are determined by means of the model 10. Where present, the model 10 is implemented within the control device 6, in particular based on the processing of the machine code 8. In some cases, it may be possible that the normal target variables are varied or updated on the basis of the determined operating values A. The particular target variables are not however influenced by the operating values A.

In a step S6, the control device 6 controls the portion of the hot rolling mill. This control takes place during processing of the corresponding flat rolling material 1, i.e. in particular during passage of the respective rolling material 1 through the portion of the hot rolling mill. During step S6, the control device 6 operates the portion of the hot rolling mill according to the determined operating values A. It thus actuates the control elements of the portion of the hot rolling mill—for example, the valves 4 of the cooling devices 3—in accordance with the determined operating values A.

The states which the rolling material 1 may have after processing in the portion of the hot rolling mill may be either target variables or operating values A. The two situations are however mutually exclusive. A state which the rolling material 1 has after processing in the portion of the hot rolling mill cannot therefore be both a target variable and an operating value A simultaneously. For example, the reeling temperature T2 may be either a target variable or an operating value A. If the reeling temperature T2 is one of the operating values A, usually the target variables are mechanical properties of the rolling material 1 which the rolling material 1 should have after processing in the portion of the hot rolling mill.

Also, the operating values A may be determined as required. In particular, they may be values which correspond directly to correcting variables for the control elements of the hot rolling mill. For example, one of the control variables may be the number of valves 4 which are opened in order for the corresponding cooling devices 3 to spray coolant onto the flat rolling material 1. Alternatively or additionally (in a similar fashion, but not completely identically), it may be the extent to which the valves 4 are opened.

After processing of the rolling material 1, the control device 6 returns to step S1. Steps S1 to S6 are thus carried out iteratively for a new rolling material 1 each time. It is important here that, with respect to the respective particular target variable, the offset δZ which is used for the respective performance of step S3 is not always the same. When all rolling materials 1 are considered, the offset δZ for a specific particular target variable therefore has several different values. This applies to each particular target variable.

In the simplest case, the offset δZ always has one of two values, wherein the two values are equal in amount. If, for example, a target variable is the reeling temperature T2, the provisional setpoint T2* for the reeling temperature T2 may be increased by a specific amount, for example 5 K or 10 K, for some of the flat rolling materials 1, and reduced by the same amount for others of the flat rolling materials 1. In a further simple case, the offset δZ always has one of three values, wherein one of these values is 0 and the other two values are different from 0 and equal in amount. Similarly to the previous example, the provisional setpoint T2* for the reeling temperature T2 may remain unchanged for some of the flat rolling materials 1, be increased by a specific amount, for example 5 K or 10 K, for some others of the flat rolling materials 1, and reduced by the same amount for yet others of the flat rolling materials 1. In a further simple case, the offset δZ always has one of two values, wherein one of the values is 0 and the other value differs from 0. Evidently, other values are also possible for the offset δZ. For example, the offset δZ may be determined by means of a random generator.

Figure 4:
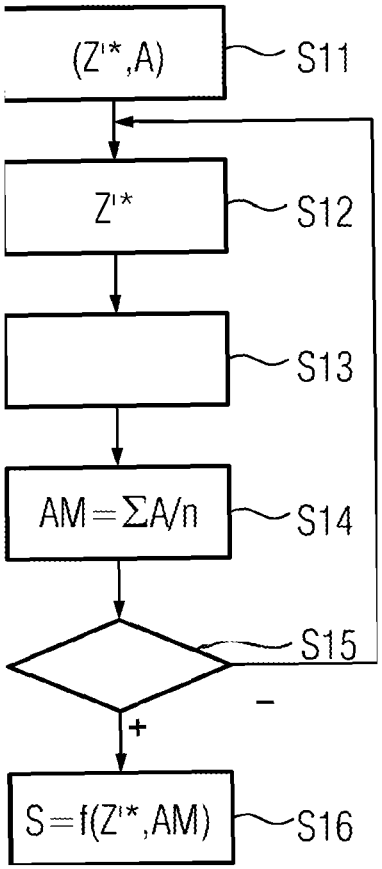

With reference to FIG. 4, the sense and purpose of the operating method according to the invention for the portion of the hot rolling mill are now explained below. Here, purely as an example, it is assumed that in a sufficient number of cases, always the same rolling material 1 is processed and the provisional setpoints Z* of the target variables are always the same. It is also assumed that the primary data PD and the provisional setpoints Z*, which were given to the control device 6 for the respective performance of steps S1 and S2, are always the same. These assumptions however serve merely for better explanation of the present invention and are not essential for the actual operation of the portion of the hot rolling mill. Furthermore, the procedure in FIG. 4 may be executed by the control device 6. Alternatively, it may also be executed by a separate computing device. It is assumed below that the procedure of FIG. 4 is executed by a separate computing device. Furthermore, only a single particular target variable and only a single operating value A are discussed. The procedure of FIG. 4 may however simply also be applied to multiple particular target variables and multiple operating values A.

According to FIG. 4, in a step S11, the computing device 4 receives a value pair for each of the rolling materials 1 to be processed. The one value of the respective value pair is the respective definitive setpoint Z'* of the particular target variable. The other value of the respective value pair is the associated operating value A, according to which the portion of the rolling mill is operated during processing of the respective rolling material 1.

According to FIG. 4, in a step S12, the computing device selects one of the definitive setpoints Z'* of the particular target variable. In a step S13, the computing device selects the value pair of which the definitive setpoint corresponds to the definitive setpoint Z'* selected in step S12. In a step S14, the computing device determines the mean value AM of the operating values A of the value pair selected in step S13. It thus determines the mean value AM as $$AM=(\Sigma A)/n$$

wherein n is the number of value pairs which was selected in step S13.

Figure 5:
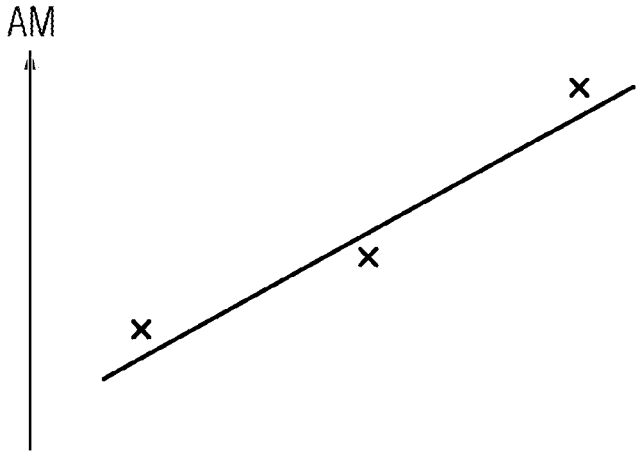
FIG. 5 shows a temperature diagram.

In a step S15, the computing device checks whether it has performed steps S12 to S14 already for all definitive setpoints Z'* of the particular target variable. If this is not the case, the computing device returns to step S12. On further performance of step S12, the computing device selects a new definitive setpoint Z'* of the particular target variable which it has not yet selected during the procedure of FIG. 4. Otherwise, the computing device proceeds to a step S16. In step S16, the computing device determines, from the determined mean value AM and the respective associated setpoints Z'* of the particular target variable, a sensitivity S of the particular target variable to the operating variable. For example, according to the illustration in FIG. 5, as part of step S16, the computing device may perform a linear regression and determine the gradient of the resulting straight line as sensitivity S.

Figure 6:
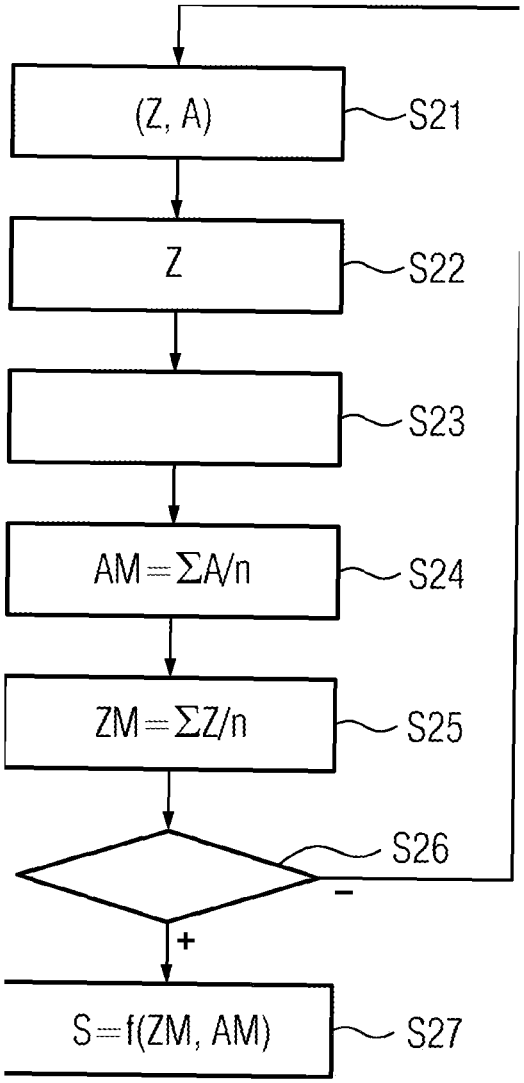
FIGS. 6 to 9 show flow diagrams.

FIG. 6 shows an alternative to the procedure of FIG. 4.

According to FIG. 6, in a step S21, the computing device is given value groups. Step S21 corresponds largely to step S1*l* of FIG. 4. However it differs from step S1*l* in that the computing device in step S21, alternatively or in addition to the definitive setpoints Z'*, is (also) given the actual values Z of the particular target variable. The actual values Z may, for example in the case of material properties of the flat rolling materials 1, be determined by testing and supplied to the computing device. In the case of a state variable (for example, the reeling temperature T2), they may often be determined directly by measurement and transmitted to the computing device.

In a step S22, the computing device selects one of the definitive setpoints Z'* of the particular target variable (where known) or a specific, usually relatively small value range for the actual value Z. Step S22 largely corresponds to step S2 from FIG. 4.

In a step S23, the computing device selects the value pairs of which the definitive setpoint corresponds to the definitive setpoint Z'* selected in step S22, or the actual value of which lies in the selected value range. Step S23 largely corresponds to step S13 of FIG. 4.

In a step S24, the computing device determines the mean value AM of the operating values A of the value pairs selected in step S23. It thus determines the mean value AM as $$AM=(\Sigma A)/n$$

wherein n is the number of value pairs which was selected in step S13. Step S24 largely corresponds to step S14 in FIG. 4.

In a step S25, in a similar fashion to the procedure in step S24 for the value pairs selected in step S22, the computing device determines the mean value ZM of the actual values Z of the particular target variable. It thus determines the mean value ZM as $$ZM=(\Sigma Z)/n$$

wherein, as before, n is the number of value pairs which was selected in step S22.

In a step S26, the computing device checks whether it has already carried out steps S22 to S25 for all definitive setpoints Z'* of the particular target variable or value ranges of the associated actual value Z. If this is not the case, the computing device returns to step S22.

On repeat performance of step S22, the computing device selects a new definitive setpoint Z'* of the particular target variable which it has not yet selected during the procedure of FIG. 6, or another value range of the actual value Z which it has not yet selected during the procedure of FIG. 6. Otherwise, the computing device proceeds to a step S27. Step S26 largely corresponds to step S15 of FIG. 4.

In a step S27, from the determined mean values AM of the updated actuating values A and the respective associated mean values ZM of the actual values Z of the particular target variable, the computing device determines the sensitivity S of the particular target variable to the operating variable. For example, in step S27, similarly to step S16, the computing device may perform a linear regression and determine the gradient of the resulting straight line as sensitivity S.

The sensitivity S of the particular target variable to the operating variable is thus determined from the setpoints or the mean values of the actual values of the particular target variable and the mean values of the setpoints or actual values of the operating values A.

The procedure in FIG. 4 is particularly suitable if the actual value Z of the particular target variable has already been detected during passage of the respective rolling material 1 through the portion of the hot rolling mill, and can be regulated to the definitive setpoint Z'*, or if for other reasons it is guaranteed that the actual value Z does not deviate or only slightly deviates from the corresponding definitive setpoint Z'*. For a cooling line, this is typically the case if the particular target variable is the reeling temperature T2. The procedure of FIG. 6 may always be used. It must be used if the actual value Z of the particular target variable cannot be regulated during passage of the respective rolling material 1 through the portion of the hot rolling mill, or if for other reasons there is a risk that the actual value Z deviates significantly from the corresponding relative setpoint Z'*. As far as possible, the procedure of FIG. 4 is however preferred since it can be carried out with less complexity.

In cases in which the target variables are themselves again determined using superordinate values, the sensitivities S of the superordinate values on the operating values may still be determined. One example: the superordinate value is a mechanical property of the rolling material 1, for example the tensile strength. From the tensile strength, the setpoint T2* for the reeling temperature T2 is determined. The reeling temperature T2 is the target variable, so the offset is added to its setpoint. The correcting variable is the actuation of the valves 4. In this case, alternatively or additionally to determining the sensitivity of the reeling temperature T2 to the actuation of the valves 4, the sensitivity of the mechanical property of the rolling material 1 to the actuation of the valves 4 may also be determined.

Possible embodiments of the procedure according to the invention (see FIGS. 1 to 3) are explained below in conjunction with FIGS. 7 and 8. These procedures are based on the embodiment explained above, in which the portion of the hot rolling mill comprises a cooling line.

Figure 7:
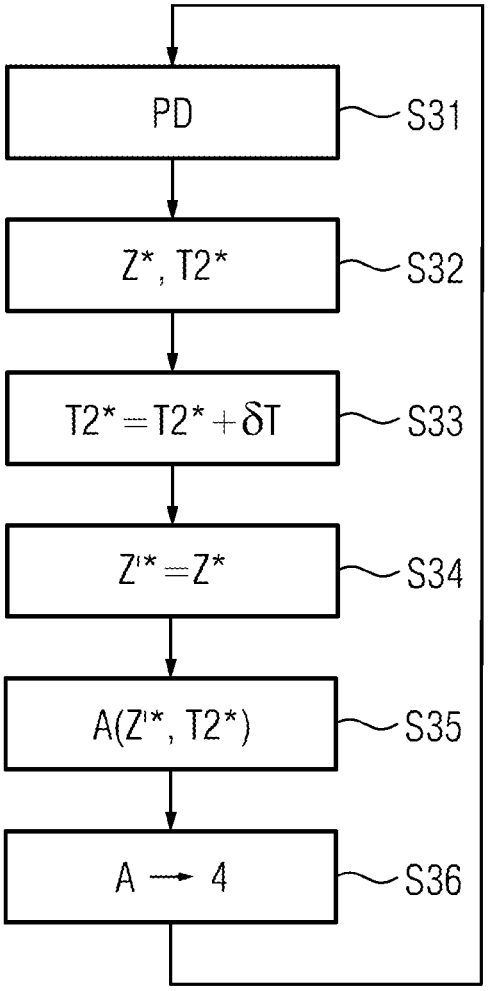

FIG. 7 comprises steps S31 to S36. In step S31, the control device 6—similarly to step S1 of FIG. 3—receives the primary data PD for a respective flat rolling material 1. In step S32, similarly to step S2 of FIG. 3, the control device 6 receives the provisional setpoints Z* for target variables for the rolling material 1. During step S32, the control device 6 receives, as one of the provisional setpoints Z*, a setpoint T2* for the reeling temperature T2. In the context of the embodiment in FIG. 7 therefore, the reeling temperature T2 is a target variable. Furthermore, in the context of the embodiment of FIG. 7, the reeling temperature T2 is the particular target variable, so in step S33, the offset δZ as a temperature offset δT is added to the provisional setpoint T2* and thus a definitive setpoint T2* for the reeling temperature T2 is determined. For the normal target variables, in step S34, similarly to step S4 of FIG. 3, the control device 6 directly uses the respective provisional setpoint Z* as the respective definitive setpoint Z'*. The operating values A of the portion of the hot rolling mill are determined by the control device 6 in step S35, similarly to step S5 of FIG. 3. The operating values A are however determined depending on the definitive temperature setpoint T2*. In step S36, the control device 6 controls the portion of the hot rolling mill, during processing of the corresponding flat rolling material 1, in accordance with the determined operating values A. Here, at least one of the operating values A influences the number of actuated valves 4 of the cooling line and/or the extent of actuation of valves 4 of the cooling line, or in general the extent of cooling.

Figure 8:
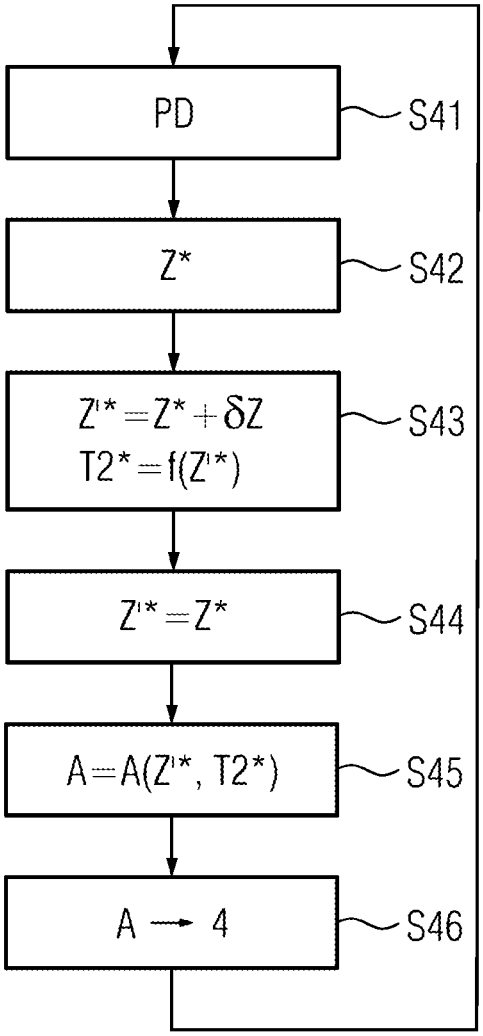

FIG. 8 comprises steps S41 to S46. In step S41, the control device 6—similarly to step S1 of FIG. 3—receives the primary data PD for a respective flat rolling material 1. In step S42, similarly to step S2 of FIG. 3, the control device 6 receives the provisional setpoints Z* for target variables for the rolling material 1. During step S43, the control device 6—similarly to step S3 of FIG. 3—changes the respective provisional setpoint Z* for the particular target variables by an offset δZ, and thus determines a respective definitive setpoint Z'*. Furthermore, in the context of the embodiment of FIG. 8, the reeling temperature T2 is not directly a particular target variable but correlates with one of the particular target variables. Therefore, in step S43, after determining the definitive setpoint Z'* for this particular target variable, using its definitive setpoint Z'*, the control device 6 determines the setpoint T2* for the reeling temperature T2. For the normal target variables, in step S44, similarly to step S4 of FIG. 3, the control device 6 directly uses the respective provisional setpoint Z* as the respective definitive setpoint Z'*. Then in step S45, the control device 6 determines the operating values A of the portion of the hot rolling mill. These are determined such that the respective rolling material 1, after passing through the portion of the hot rolling mill, amongst others reaches the setpoint T2*, determined in step S43 for the reeling temperature T2, as well as possible. In step S46, the control device 6 controls the portion of the hot rolling mill, during processing of the corresponding flat rolling material 1, according to the determined operating values A. Here, at least one of the operating values A influences the number of actuated valves 4 of the cooling line and/or the extent of actuation of the valves 4 of the cooling line, or generally the extent of cooling. The procedure according to FIG. 8 is therefore based on the fact that the particular target variable is not directly the reeling temperature T2. The particular target variable in this case may in particular be a micromechanical or macromechanical property of the rolling material 1, for example the tensile strength or proof stress.

Figure 9:
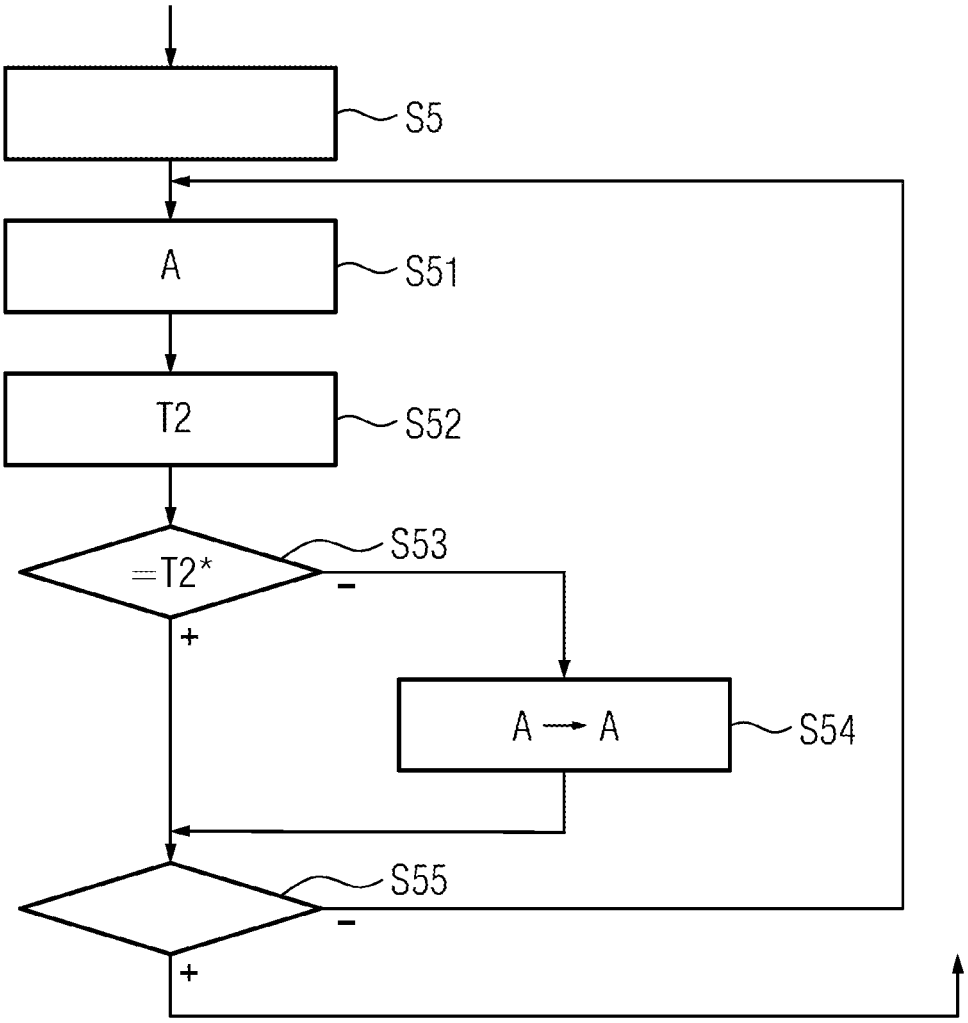

A further possible embodiment of the procedure according to the invention (see FIGS. 1 to 3) is explained below in conjunction with FIG. 9. This procedure is preferably also based on the above-described embodiment in which the portion of the hot rolling mill comprises a cooling line. It is however not necessarily coupled to a cooling line, although the embodiment in FIG. 9 is explained below in connection with a cooling line. If the portion of the hot rolling mill comprises a cooling line, the procedure of FIG. 9 may be combined with the embodiments of FIGS. 7 and 8.

FIG. 9 shows a possible embodiment of step S6 from FIG. 3. In the context of the embodiment of FIG. 9, it is assumed that, during passage of the respective flat rolling material 1 through the portion of the hot rolling mill, an actual value of a state variable of the rolling material 1 has been detected and supplied to the control device 6. For example, in the case of a cooling line (see FIGS. 1 and 2), a further temperature measuring point 11 may be arranged at the outlet from the cooling line, by means of which the reeling temperature T2 (i.e. its actual value) is detected.

According to FIG. 9, in a step SM, the control device 6 firstly actuates the portion of the hot rolling mill. This actuation takes place with the current operating values A. The current operating values A correspond to the operating values A determined in step S5 of FIG. 3 on the first performance of step SM.

In a step S52, the control device 6 receives the detected actual value of the state variable (for example, the detected reeling temperature T2). The state variable—see, purely as an example, the statements relating to FIG. 7—may be one of the particular target variables. In this case therefore, the corresponding setpoint T2* of the state variable T2 correlates with the definitive setpoint Z'* of this particular target variable. Alternatively, the detected state variable—see, purely as an example, the statements relating to FIG. 8—correlates with one of the particular target variables. In this case, the setpoint T2* of the state variable T2 is determined by the definitive setpoint Z'* of this particular target variable.

Irrespective of whether the one or the other situation applies, in a step s53, the control device 6 compares the actual value T2 of the state variable with the associated setpoint T2*. In the case of a deviation, the control device 6 proceeds to a step S54. In step S54, the control device 6 updates at least one operating value A. The state variable T2 is influenced by the updated operating variable A. The updating takes place to compensate for the deviation of the actual value T2 of the state variable from the associated setpoint T2*.

Then in a step S55, the control device 6 checks whether the processing of the rolling material 1 in the portion of the hot rolling mill is ended. If this is not the case, the control device 6 returns to step S51. On renewed performance of step S51, the control device 6 however uses the now current operating values A, i.e. as they have resulted following any update in step SM. If treatment of the rolling material 1 in the portion of the hot rolling mill has ended, the procedure of FIG. 9 also ends. The control device 6 thus returns to step S1 (see FIG. 3).

In the context of the procedure of FIG. 9, the respective flat rolling material 1 is theoretically divided into a plurality of portions which follow one another sequentially. If the state variable is detected, for a particular portion of the rolling material 1, this portion of the rolling material 1 can no longer be influenced by means of the portion of the hot rolling mill. However, following portions of the flat rolling material 1, for which the state variable is detected at a later time, may be influenced by the portion of the hot rolling mill. Regulation of the state variable is thus associated with a certain dead time. This is not a problem however, and restricts merely the dynamics of regulation and not the principle. The corresponding situation is generally known to and trusted by persons skilled in the art.

As already stated, the offset $\delta Z$ is freely selectable as long as its absolute value remains below a particular threshold. In connection with FIGS. 10 and 11, possibilities will now be presented for suitably determining the offset $\delta Z$ or a maximum value for the amount of the offset $\delta Z$.

Figure 10:
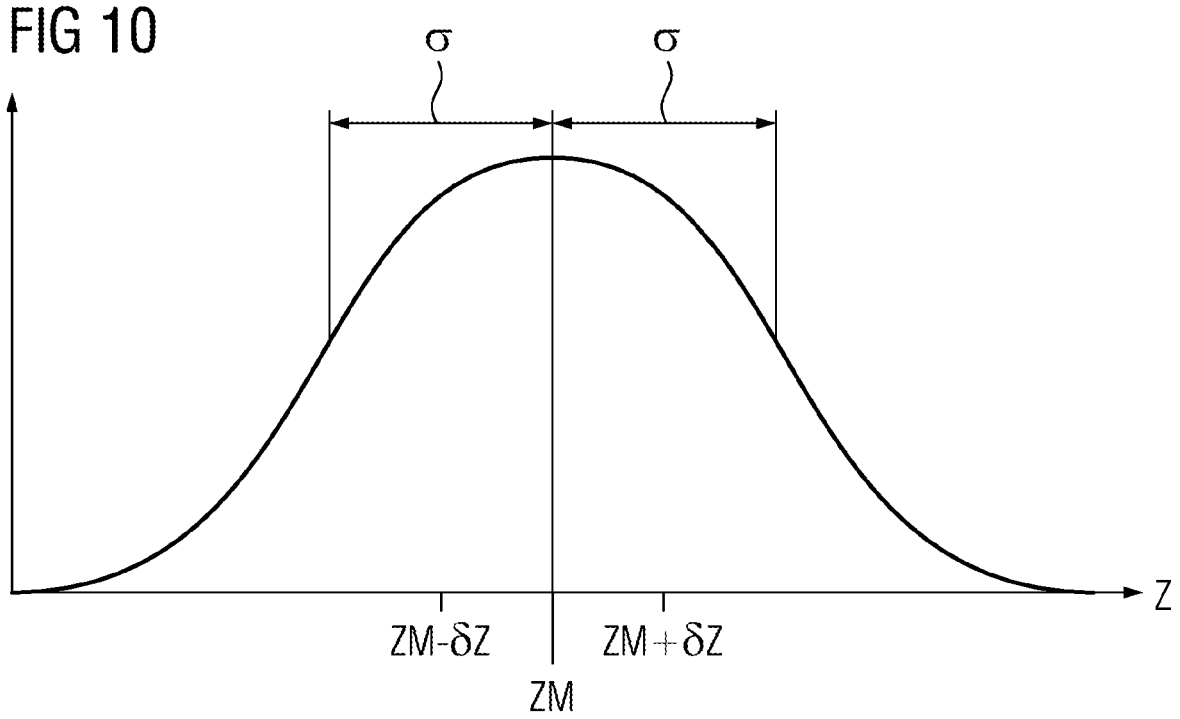
FIGS. 10 and 11 show probability distributions.

In the context of FIG. 10, three assumptions are made. Firstly, it is assumed that the processed rolling materials 1 are uniform. Secondly, it is assumed that the provisional setpoint Z* of the particular target variable is used directly as the definitive setpoint Z'* of the particular target variable, i.e. step S3 of FIG. 3 is omitted and step S4 is carried out for all target variables. Thirdly, it is assumed that the operating values A are not updated, i.e. in particular, the procedure of FIG. 9 is not implemented.

In the case of the above assumptions, the operating values A always remain the same from rolling material 1 to rolling material 1. The operating values A are no longer changed after their determination in step S5. In this case however, the actual value Z of the particular target variable—for example the reeling temperature T2—varies from rolling material 1 to rolling material 1. The reason for the spread may be assumed to be an external fault. The cause of the spread may be known but need not be known.

The spread of the actual value Z of the particular target variable has a standard deviation $\sigma$ about the mean value ZM of the actual value Z of the particular target variable. The standard deviation $\sigma$ is often also called the variance. The standard deviation $\sigma$ is defined in that it covers a symmetrical region around the mean value ZM. With a normal distribution, around ⅔ of all measurement values (more precisely 68.27%) lie in the region with one times the standard deviation $\sigma$ (i.e. in the region which extends from the mean value ZM of the actual value Z of the particular target variable minus the standard deviation $\sigma$ to the mean value ZM of the actual value Z of the particular target variable plus the standard deviation $\sigma$). With a normal distribution, around 95% of all measurement values (more precisely 95.45%) lie in the range with two times the standard deviation $\sigma$. With a normal distribution, almost all measurement values (more precisely 99.73%) lie in the region with three times the standard deviation σ.

According to the illustration in FIG. 10, the offset δZ may be determined for example such that its amount is less than the standard deviation σ. Thus the various definitive setpoints Z'* of the particular target variable deviate from the corresponding provisional setpoint Z* by less than the spread (more precisely, by less than the standard deviation σ). It is naturally even better if the amount of the offset δZ has an even smaller value, in particular so that the deviation from the corresponding provisional setpoint Z* is less than half the spread.

FIG. 10 however shows a hypothetical situation. The circumstances in which the operating values A are not updated may lead to a considerable spread, which is reflected in the actual value Z of the particular target variable. Usually therefore the operating values A are updated. The determination of the offset δZ for this case—a realistic case—is explained below in conjunction with FIG. 11.

Figure 11:
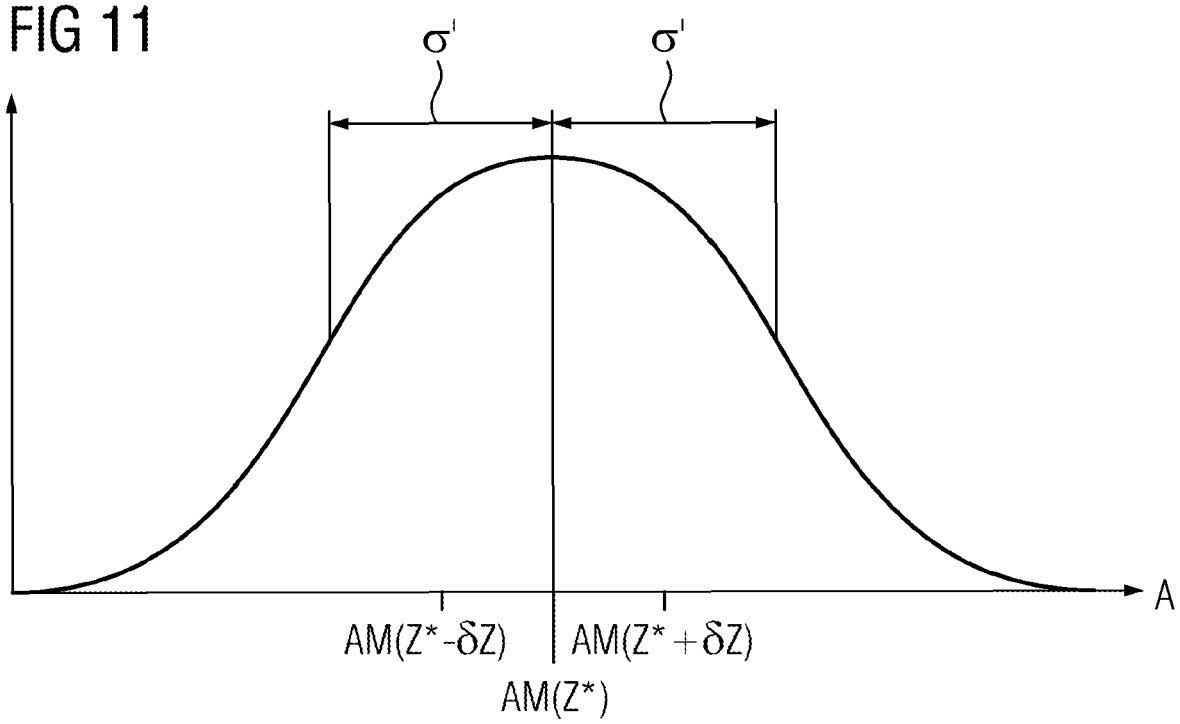

In the context of FIG. 11, as in FIG. 10, it is assumed that the processed rolling materials 1 are uniform and the provisional setpoint Z* is used directly as the definitive setpoint Z'* of the particular target variable. In contrast to the explanations for FIG. 10, however, the operating values A are updated in order to keep a state variable—for example, the reeling temperature T2—at its setpoint T2*. The state variable is either a particular target variable or correlates with a particular target variable. As part of the updating of the operating values A, in particular the procedure from FIG. 9 may be implemented.

In the case of FIG. 11, the actual value Z of the particular target variable—for example, the reeling temperature T2—is always the same or at least approximately the same from rolling material 1 to rolling material 1. However, the operating values A vary from rolling material 1 to rolling material 1.

In this case, the operating values A have a standard deviation σ' around their mean value AM. The standard deviation σ' is defined similarly to FIG. 10 in that it covers a symmetrical region about the mean value AM of the operating values A. With a normal distribution, around ⅔ of all operating values A (more precisely 68.27%) lie in the region with one times the standard deviation σ' (i.e. in the region which extends from the mean value AM minus the standard deviation σ' to the mean value AM plus the standard deviation σ'). With a normal distribution, around 95% of all operating values A (more precisely 95.45%) lie in the range with two times the standard deviation σ'. With a normal distribution, almost all operating values A (more precisely 99.73%) lie in the region with three times the standard deviation σ'.

The offset δZ may be determined for example such that—with respect to the respective offset δZ—the mean value AM of the operating values A deviates by less than the spread from the mean value AM which results on use of the provisional setpoint Z* itself as the definitive setpoint Z'* of the particular target variable. It is naturally even better if the amount of the offset 6Z has an even smaller value, in particular a value which corresponds at most to half the spread of the operating values A.

The procedure from FIG. 10 and in particular the procedure from FIG. 11 ensure that, in practice only slight shifts of the actual values Z of the particular target variable occur. Nonetheless, the sensitivity S can be determined with sufficient accuracy. An example will explain this in more detail. In the context of this example, the reeling temperature T2 is taken as the particular target variable. The corresponding statements are however generally valid.

It is assumed that an unknown error, if not compensated by updating of the operating values A, would cause a spread of the reeling temperature T2 by 7 K (i.e. σ=7 K). The provisional setpoint Z* is 600° C. In the context of the procedure according to the invention, 2500 rolling materials 1 are processed for which the definitive setpoint Z'* of the particular target variable is 599° C., i.e. the offset δZ is −1 K. For a further 2500 rolling materials 1, a definitive setpoint Z'* of the particular target variable of 601° C. is used, i.e. the offset δZ is +1 K.

If, for the embodiment according to FIG. 9, the respective mean value AM of the updated operating values A is calculated, the mean value AM can be calculated with a precision which corresponds to a spread of the reeling temperature T2 of 0.14 K. The sensitivity S can therefore be determined despite the only very slight change in the setpoint T2* of the reeling temperature T2.

Initially, this procedure supplies the correct prefix of the sensitivity S. This in itself constitutes a substantial advantage in comparison with the prior art. The determination is still however only accurate to around 15%. This accuracy is nonetheless completely adequate for many applications. It may be improved further by a corresponding increase in the number of rolling materials 1. On the other hand, the slight variation in the setpoint T2* has almost no effects on the quality of the rolling materials 1 actually processed. The resulting spread over all 5000 rolling materials 1 is increased only from 7 K to around 7.07 K, and hence relatively only by around 1%. Alternatively or additionally, naturally it is also possible to increase the offset 6Z.

The determined sensitivity S may in particular be used to update the model 10. If, at a later time, in the context of the model 10, the operating values A are to be determined for at least one further flat rolling material 1, the determined sensitivity S may be used for determining the operating values A. This may be advantageous in particular if the setpoint Z0* or the target value Z0' of the particular target variable has changed, and/or if the primary data PD have changed.

The present invention has many advantages.

In contrast to the prior art, the aim is not to establish, by a global approach, a direct correlation between the measured material properties of the flat rolling materials 1 on one side, and adjustment values in the portion of the hot rolling mill on the other. Instead, without more extensive assumptions, the sensitivity S is determined, or at least its prefix and approximate value are determined. The advantage is that the operator of the portion of the hot rolling mill usually knows very precisely the primary data PD and the provisional setpoints Z* of the target variables, but does not usually know how he must change the operating values A in order to set the actual values Z of the target variables in deterministic fashion. With the procedure of the present invention however, this becomes possible. In particular, the working point of the portion of the hot rolling mill can be shifted in targeted fashion, so as to give a flat rolling material 1 with improved actual values Z of the target variables. Furthermore, errors in upstream processing procedures, i.e. in processes which influence the primary data PD, can be completely or at least partially compensated.

The present invention has largely been explained above for the case that the portion of the hot rolling mill corresponds to a cooling line or at least comprises a cooling line. Usually, the reeling temperature T2 of the rolling material 1 at the outlet from the cooling line is taken as a particular target variable. Usually, the number of actuated valves 4 of the cooling line and/or the extent of actuation of the valves 4 of the cooling line is taken as an operating value A. The present invention is not however restricted to this embodiment.

For example, it is possible that the portion of the hot rolling mill is indeed a cooling line or comprises a cooling line, but the particular target variable is not the reeling temperature T2. In this case, the procedure may be followed similarly to the procedure explained above. It must merely be considered that the setpoint T2* of the reeling temperature T2 (or in general, the setpoint of the state variable to be regulated) correlates with the particular target variable. If, for example, a specific tensile strength is predefined as a particular target variable, the tensile strength varies stochastically independently of the other target variables and the primary data PD. In each case, the respective setpoint T2* of the reeling temperature T2 is determined and regulated to this value. The associated mean values AM of the operating values A are in this case determined and evaluated in relation to the respective mean value ZM of the actual values Z of the tensile strength. Similar procedures apply for other particular target variables.

It is also possible that the procedure according to the invention is carried out for a portion of a hot rolling mill which does not comprise a cooling line. For example, in the case of a production line, the final rolling temperature T1 may be given as a particular target variable, and the final rolling speed v used as the particular correcting variable. Also, another target variable may be used, and the final rolling temperature T1 used as the state variable.

It is also possible to provide other particular target variables. One example is the extent to which a phase conversion of the rolling material 1 has taken place at the outlet from the considered portion of the hot rolling mill. The measurement value, on the basis of which the operating values A are updated, may be the final rolling temperature T1 in the case of a production line, or the reeling temperature T2 in the case of a cooling line.

Other embodiments are also possible. For example, insofar as the portion of the hot rolling mill is configured as a multistand production line, or comprises a multistand production line, the thickness, profile and/or flatness of the rolling material 1 may be used as a particular target variable, and as operating values A, values may be used which influence the roll gap of the last roll stand 2 of the multistand production line, and/or the penultimate roll stand 2 of the multistand production line, and/or further roll stands 2 of the multistand production line.

The above-mentioned examples should not be regarded as restrictive. Other embodiments are also possible.

Although the invention has been illustrated and described in detail with reference to the preferred exemplary embodiment, the invention is not restricted by the disclosed examples, and other variants may be derived by the person skilled in the art without leaving the scope of protection of the invention.

LIST OF REFERENCE SIGNS

1 Rolling materials
2 Roll stands
3 Cooling devices
4 Valves
5 Reel
6 Control device
7 Computer program
8 Machine code
9, 11 Temperature measurement point
10 Model
A Operating values
AM Mean value of actuation values of particular correcting variable
PD Primary data
S Sensitivity
S1 to S55 Steps
T1 Final rolling temperature
T2* Setpoint of reeling temperature
T2 Reeling temperature
V Final rolling speed
Z* Provisional setpoints of target variables
Z'* Definitive setpoints of target variables
Z Actual value of particular target variable
ZM Mean value of actual values of particular target variable
δT Temperature offset
δZ Offset
σ, σ' Standard deviations

The invention claimed is:

1. An operating method for a portion of a hot rolling mill, comprising:

supplying a control device for the portion of the hot rolling mill with respective primary data for a plurality of rolling materials and respective provisional setpoints for target variables of the respective rolling material, the respective primary data describing the respective rolling material before being supplied to the portion of the hot rolling mill, and the respective provisional setpoints of the target variables describing a desired nominal state of the respective rolling material after passing through the portion of the hot rolling mill;

determining, by the control device, operating values for the portion of the hot rolling mill such that the respective rolling material, after passing through the portion of the hot rolling mill, approaches or reaches definitive setpoints of the target variables; and operating, by the control device during processing of the respective rolling material, the portion of the hot rolling mill according to the determined operating values;

wherein at least one of the target variables is a particular target variable, and the remaining target variables are normal target variables;

wherein the particular target variable is at least one of:

a reeling temperature defining a target temperature for the respective rolling material after passing through a cooling line;

a material property of the respective rolling material comprising at least one of a proof stress, a yield strength, and a breaking strength; and a macroscopic material property of the respective rolling material comprising at least one of a tensile strength, a yield strength, and a ductile yield;

wherein the control device determines the respective definitive setpoint for the particular target variable by changing the respective provisional setpoint by a respective offset which is determined independently of the primary data and the normal target variables for the respective rolling material, and also independently of the operating values of the hot rolling mill determined for processing the respective rolling material;

wherein further offsets, with respect to the respective particular target variable are provided for others of the plurality of rolling materials, have multiple different values when all the rolling materials are viewed as a whole; and wherein the control device, for the normal target variables, uses the respective provisional setpoint unchanged as the respective definitive setpoint.

2. The operating method as claimed in claim 1, wherein the respective offset is freely selectable completely or within a predefined value range.

3. The operating method as claimed in claim 1, wherein with respect to a respective particular target variable, the actual value which would result on use of the respective provisional setpoint as a respective definitive setpoint, on condition that the operating values for the respective rolling material are not updated on passage through the portion of the hot rolling mill, would vary with a statistical spread, and the respective offset for this particular target variable is smaller than the spread.

4. The operating method as claimed in claim 3, wherein a respective offset of the further offsets and the respective offset for this particular target variable is smaller than half the spread.

5. The operating method as claimed in claim 1, wherein at least one of the particular target variables is a microscopic or macroscopic material property of the respective rolling material.

6. An operating method for a portion of a hot rolling mill, comprising:

supplying a control device for the portion of the hot rolling mill with respective primary data for a plurality of rolling materials and respective provisional setpoints for target variables of the respective rolling material, the respective primary data describing the respective rolling material before being supplied to the portion of the hot rolling mill, and the respective provisional setpoints of the target variables describing a desired nominal state of the respective rolling material after passing through the portion of the hot rolling mill;

determining, by the control device, operating values for the portion of the hot rolling mill such that the respective rolling material, after passing through the portion of the hot rolling mill, approaches or reaches definitive setpoints of the target variables; and operating, by the control device during processing of the respective rolling material, the portion of the hot rolling mill according to the determined operating values;

wherein at least one of the target variables is a particular target variable, and the remaining target variables are normal target variables;

wherein the control device determines the respective definitive setpoint for the particular target variable by changing the respective provisional setpoint by a respective offset which is determined independently of the primary data and the normal target variables for the respective rolling material, and also independently of the operating values of the hot rolling mill determined for processing the respective rolling material;

wherein further offsets, with respect to the respective particular target variable are provided for others of the plurality of rolling materials, have multiple different values when all the rolling materials are viewed as a whole;

wherein the control device, for the normal target variables, uses the respective provisional setpoint unchanged as the respective definitive setpoint; and wherein:

during passage of the respective rolling material through the portion of the hot rolling mill, an actual value of a state variable of the rolling material is supplied to the control device;

the state variable is one of the particular target variables, so a setpoint of the state variable corresponds to the definitive setpoint of this particular target variable, or the state variable correlates with the at least one particular target variable, so that a setpoint of the state variable is determined by the definitive setpoint of the at least one particular target variable; and on a deviation of the actual value of the state variable from the setpoint of the state variable, the control device provides at least one operating value which influences the state variable during passage of the respective rolling material through the portion of the hot rolling mill, in order to compensate for the deviation of the actual value of the state variable from the setpoint of the state variable.

7. The operating method as claimed in claim 6, wherein with respect to a particular definitive setpoint of another particular target variable, further operating values vary with a statistical spread, and with respect to the other particular target variable, a particular offset is selected such that the mean values of the further operating values for the respective definitive setpoint of this target variable deviate by less than the spread from a respective mean value of the least one operating value which results on use of the respective provisional setpoint as the definitive setpoint of the other particular target variable.

8. The operating method as claimed in claim 7, wherein the respective offset and the further offsets are selected such that the mean values of the at least one operating value for the respective definitive setpoint of this target variable deviate by less than half the spread.

9. An operating method for a portion of a hot rolling mill, comprising:

supplying a control device for the portion of the hot rolling mill with respective primary data for a plurality of rolling materials and respective provisional setpoints for target variables of the respective rolling material, the respective primary data describing the respective rolling material before being supplied to the portion of the hot rolling mill, and the respective provisional setpoints of the target variables describing a desired nominal state of the respective rolling material after passing through the portion of the hot rolling mill;

determining, by the control device, operating values for the portion of the hot rolling mill such that the respective rolling material, after passing through the portion of the hot rolling mill, approaches or reaches definitive setpoints of the target variables; and operating, by the control device during processing of the respective rolling material, the portion of the hot rolling mill according to the determined operating values;

wherein at least one of the target variables is a particular target variable, and the remaining target variables are normal target variables;

wherein the control device determines the respective definitive setpoint for the particular target variable by changing the respective provisional setpoint by a respective offset which is determined independently of the primary data and the normal target variables for the respective rolling material, and also independently of the operating values of the hot rolling mill determined for processing the respective rolling material;

wherein further offsets, with respect to the respective particular target variable are provided for others of the plurality of rolling materials, have multiple different values when all the rolling materials are viewed as a whole;

wherein the control device, for the normal target variables, uses the respective provisional setpoint unchanged as the respective definitive setpoint; and wherein the portion of the hot rolling mill comprises a cooling line, and one of the particular target variables is the reeling temperature of the rolling material at an outlet from the cooling line or correlates with the reeling temperature of the rolling material at the outlet from the cooling line, and at least one of the operating values influences at least one of a number of actuated valves of the cooling line and an extent of actuation of the actuated valves of the cooling line.

* * * * *